US006966624B2

(12) United States Patent
Takahashi et al.

(10) Patent No.: US 6,966,624 B2
(45) Date of Patent: Nov. 22, 2005

(54) LIQUID SPRAYING DEVICE

(75) Inventors: Masaru Takahashi, Nagano (JP); Kojiro Iizuka, Nagano (JP); Hitoshi Hayakawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 116 days.

(21) Appl. No.: 10/466,526

(22) PCT Filed: Oct. 21, 2002

(86) PCT No.: PCT/JP02/10890

§ 371 (c)(1),
(2), (4) Date: Jul. 17, 2003

(87) PCT Pub. No.: WO03/035402

PCT Pub. Date: May 1, 2003

(65) Prior Publication Data

US 2005/0030335 A1 Feb. 10, 2005

(30) Foreign Application Priority Data

Oct. 19, 2001 (JP) ..... 2001-322228

(51) Int. Cl.[7] ..... B41J 2/165
(52) U.S. Cl. ..... 347/29; 347/32; 347/31
(58) Field of Search ..... 347/29, 30, 32, 347/33; 74/89.14, 89.1

(56) References Cited

U.S. PATENT DOCUMENTS 5,455,609 A * 10/1995 Gast et al. ..... 347/32

FOREIGN PATENT DOCUMENTS

| | | | |
|---|---|---|---|
| JP | 4-72232 | A | 3/1992 |
| JP | 5-69551 | A | 3/1993 |
| JP | 6-344569 | A | 12/1994 |
| JP | 8-244243 | A | 9/1996 |
| JP | 2000-141675 | A | 5/2000 |
| JP | 2000-226139 | A | 8/2000 |
| JP | 2001-138545 | A | 5/2001 |

* cited by examiner

*Primary Examiner*—Shih-Wen Hsieh
(74) *Attorney, Agent, or Firm*—Sughrue Mion, PLLC

(57) ABSTRACT

A liquid ejecting apparatus includes drive device for moving up a cap (9*a*) of capping device (9) to a nozzle formation face seal position of a record head (12) and moving down the cap to a retreat position vertically downward from the nozzle formation face seal position. The drive device has a rack-pinion mechanism including racks (102*a* and 103*a*) disposed on both side parts of a fixed frame and pinions (102*b* and 103*b*) fixedly secured to both end parts of a support shaft (9*c*) for guiding the support shaft in an up and down direction.

7 Claims, 14 Drawing Sheets

LIQUID SPRAYING DEVICE

TECHNICAL FIELD

This invention relates to a liquid ejecting apparatus having a recovery function of sucking and discharging liquid from a liquid ejecting head for recovering an ejection function.

BACKGROUND ART

A background art relating to the invention will be discussed by taking an ink jet record apparatus, a kind of liquid ejecting apparatus, as an example. The ink jet record apparatus produces comparatively low noise at the printing time and can record extremely small dots at a high density and thus nowadays is used for various types of print including color print.

The ink jet record apparatus ejects liquid ink in droplet form from nozzle openings. Since the nozzle openings are open, an ink solvent evaporates gradually through the nozzle openings in a non-use mode of the record apparatus. If the ink solvent evaporation amount is excessively large, a rise in viscosity occurs in ink in the vicinity of the nozzle openings and by extension clogging is caused to occur. Air bubbles may be mixed into a record head through the nozzle openings. In this case, there is a possibility that the mixed air bubbles may hinder the ink flow, causing a print failure to occur.

To prevent such trouble, the ink jet record apparatus is provided with a recovery mechanism for forcibly discharging ink in the record head through the nozzle openings. The recovery mechanism generally is made up of a cap member having a negative pressure hollow part, a suction pump communicating with the negative pressure hollow part, and a drive mechanism for moving the cap member. In the recovery operation of the recovery mechanism, first the cap member seals a nozzle opening face (namely, the formation face of the nozzle openings) and then the negative pressure pump is activated. As the negative pressure pump is activated, a negative pressure is applied in the negative pressure hollow part and ink in the record head is sucked through the nozzle openings.

As the drive mechanism, various configurations are proposed, one of which is a configuration using racks and a gear (for example, patent document 1). In the configuration, as shown in FIG. 14, a moving body 204 including a cap holder 202 having a cap member (nozzle cap) 201 placed on a tip face and a first rack 203 on a side is attached to the top of a slider 205 in a state in which it can be advanced and retreated. The cap holder 202 is attached in a state in which it can be moved in a back and forth direction relative to a main body part 206 of the moving body 204, and is urged in the advance direction by a spring 207. On the other hand, the slider 205 journals a gear 208 meshed with the first rack 203 in a rotatable state and is attached in a state in which it can be moved relative to a support 209. In particular, the slider 205 is attached in a movable state in a direction perpendicular to the move direction of the moving body 204. A spring 210 to urge the slider 205 is disposed in the support 209. In addition, a second rack 211 that can mesh with the gear 208 is also placed on the support 209.

In the configuration, when a carriage (carrier) 213 having a record head 212 is moved to the side of the slider 205, a part of the carriage 213 abuts the slider 205. If the carriage 213 further moves in the same direction in the abutment state, the slider 205 moves together with the carriage 213. As the slider 205 moves, the gear 208 placed on the slider 205 meshes with a second rack 211 placed in the support 209 and rotates. As the gear 208 rotates, the moving body 204 advances to the side of the record head 212 and the cap member 201 seals the nozzle opening face. When the carriage 213 moves in the direction away from the slider 205 from the seal state (which will be hereinafter referred to as capping state), the slider 205 moves in the same direction as the carriage 213 by the urging force of the spring 210. Also in this case, the gear 208 meshes with the second rack 211 and thus rotates in the opposite direction to that mentioned above. As the gear 208 rotates, the moving body 204 retreats in the direction away from the record head 212 and the capping state is released.

In the configuration, the move of the carriage 213 is used as the power to move the moving body 204, so that a dedicated drive source becomes unnecessary and the apparatus configuration can be simplified.

Patent document 1 mentioned above is JP-A-5-69551.

DISCLOSURE OF THE INVENTION

However, in the configuration in the related art described above, it is necessary to provide the space for the slider 205 to move in addition to the space for the moving body 204 to move. Thus, there is a problem of upsizing the apparatus as much as the space. There is also a problem of necessity for moving the slider 205 and the moving body 204 in different directions to set or release the capping state and difficulty in securing high position accuracy. Further, the moving body 204 is moved in the back and forth direction by the first rack 203 and the gear 208 placed on one side of the moving body 204 and therefore there is a possibility that the moving body 204 may be tilt. Thus, it becomes necessary to take a measure of placing the spring 207 between the main body 206 of the moving body 204 and the cap holder 202 or the like to bring the cap member 201 into intimate contact with the nozzle formation face.

It is therefore an object of the invention to make it possible to lessen a space to move a cap member as much as possible, thereby miniaturizing the whole apparatus and more enhance capping accuracy of the position of the cap member, the intimate contact property of the cap member, etc.

To accomplish the object, according to the invention, there is provided a liquid ejecting apparatus including:

a liquid ejecting apparatus comprising:

a liquid ejecting head, provided movably between an ejection area in which ejection control of droplets is possible based on ejection data and a none-jection area in which ejection control of droplets based on ejection data is not performed, and being capable of ejecting droplets from nozzle openings formed in a nozzle formation face;

capping means, disposed in the non-ejection area and including a cap member being capable of sealing the nozzle formation face;

drive means, which moves the cap member in an up and down direction between a nozzle formation face seal position of the liquid ejecting head and a retreat position set below the nozzle formation face seal position, a fixed frame, disposed below a move path of the liquid ejecting head in the non-ejection area, and having a guide long hole extending in the up and down direction; and a support shaft, which supports the cap member, and inserted into the guide long hole, wherein the drive means has a rack-pinion mechanism including a rack disposed on both side parts of the fixed frame and a pinion fixedly secured to both end parts of the support shaft for guiding the support shaft in the up and down direction; and wherein the support shaft is moved in the up and down direction along the guide long hole so that the nozzle formation face is capped by the capping member.

In this configuration, when the drive means is driven for moving up the cap member, the cap member seals the nozzle formation face of the record head and the record head is placed in the capping state. On the other hand, when the cap member is moved down, the cap member is brought away from the nozzle formation face and the capping state is released. At this time, the cap member is moved up and down, so that the space provided to move the cap member can be reduced as much as possible and the whole apparatus can be miniaturized.

Since the cap member supported by the support shaft is moved by the rack-pinion mechanism including the rack disposed on both side parts of the fixed frame and the pinion fixedly secured to both end parts of the support shaft supporting the cap member, the cap member is hard to tilt at the moving time. Therefore, the cap member can seal the nozzle formation face reliably with high accuracy.

BEST MODE FOR CARRYING OUT THE INVENTION

The best mode for carrying out the invention will be discussed. In the description to follow, the invention is applied to an ink jet record apparatus (a kind of liquid ejecting apparatus).

Figure 1:
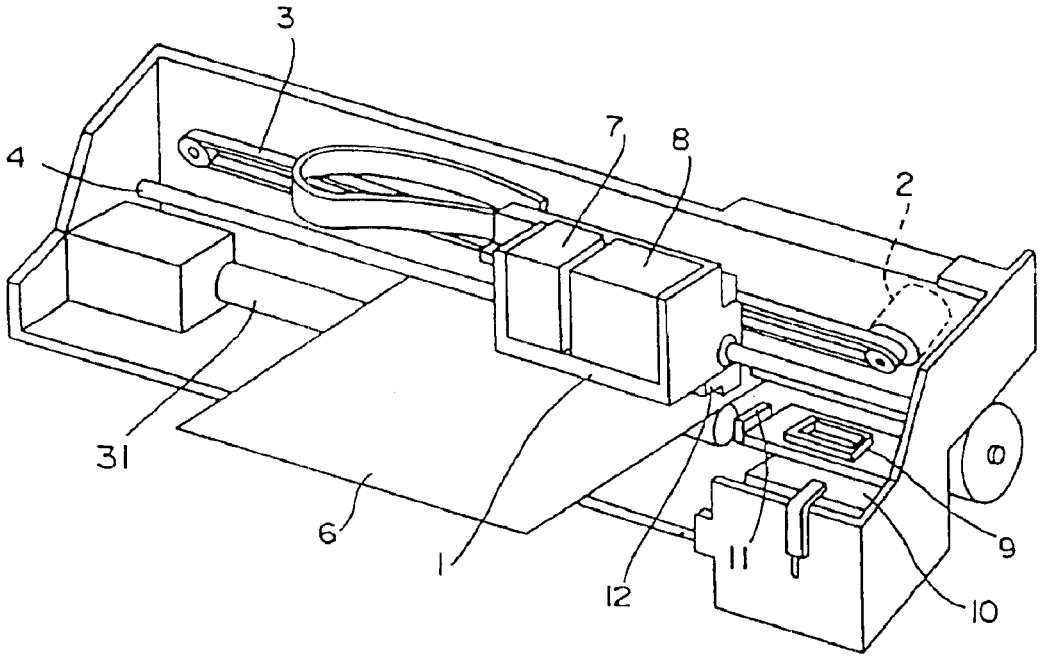
FIG. 1 is a schematic drawing to schematically show the generation configuration of an ink jet record apparatus.

As shown in FIG. 1, a carriage 1 is mounted on a guide rod 4 and is attached so that it can be moved in the axial direction of a paper feed roller 31. A timing belt 3 is connected to the carriage I and the carriage 1 is reciprocated by a carriage motor 2. That is, the carriage I can be moved along the guide rod 4 between a print area in which ejection control of ink droplets based on print data is possible and a non-print area in which ejection control of ink droplets based on print data is not performed (also called home position).

The print data is a kind of ejection data of the invention and the ink droplet is a kind of droplet of the invention. The print area is a kind of ejection area of the invention and the non-print area is a kind of non-ejection area of the invention.

The top face portion of the carriage 1 is formed as a cartridge hold portion and a black ink cartridge 7 storing liquid black ink and a color ink cartridge 8 storing liquid color ink are held in a detachable state.

On the other hand, a record head 12 is mounted on the bottom face portion of the carriage 1 (the side opposed to record paper 6). The record head 12 has an ink flow passage from an ink introduction port through a common ink chamber and pressure generation chambers to nozzle openings. The ink flow passage is divided into downstream branches from the common ink chamber and the nozzle openings at the downstream end of the ink flow passage are made in the nozzle formation face (not shown). Ink from the ink cartridge 7, 8 is introduced through the ink introduction port and the ink flow passage is filled with the ink.

When pressure generation elements (for example, electromechanical conversion elements of PZT, etc., or heating elements of heater, etc.,) disposed in the pressure generation chambers are actuated in the ink filling state, pressure fluctuation occurs in the pressure generation chambers and thus ink droplets can be ejected from the nozzle openings.

Figure 3:
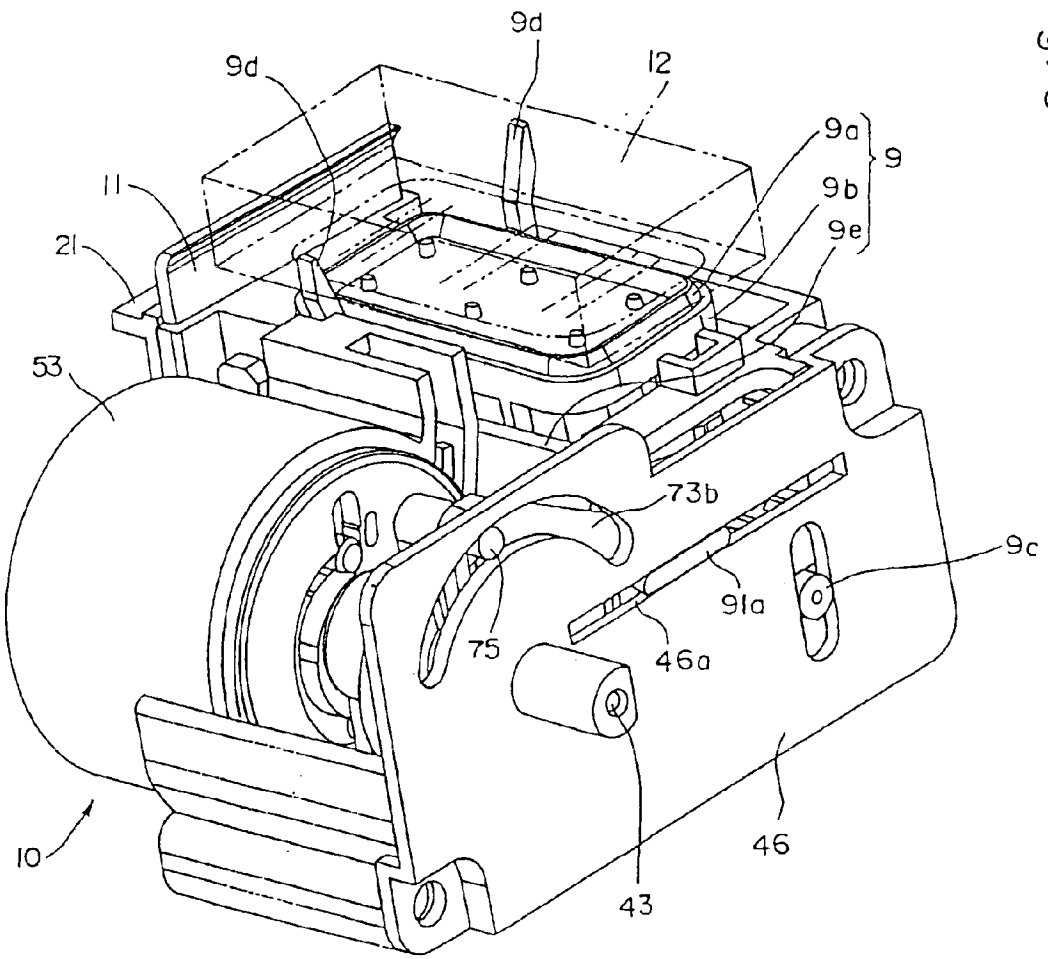
FIG. 3 is a perspective view to show the drive transmit unit of the capping drive means and a driven transmit unit.

Capping means 9 is placed in the non-print area. The capping means 9 includes a cap member 9*a* (simply, also called cap or nozzle cap) shaped like a tray with the top opened, as shown in FIG. 3. When the record head 12 moves up from the print area side to a position just above the cap member 9*a*, the capping means 9 rises from a retreat position to the nozzle formation face seal position. Accordingly, the capping member 9*a* seals the nozzle formation face of the record head 12 for placing the record head 12 in the capping state. When the record head 12 moves from the position just above the cap member 9*a* to the print area side, the capping means 9 moves down from the nozzle formation face seal position to the retreat position for releasing the record head 12 from the capping state of the cap member 9*a*.

The capping means 9 maintains the capping state and prevents trouble of an ink solvent evaporating through the nozzle openings during quiescent operation of the record apparatus. That is, the cap member 9*a* also functions as a lid for preventing ink in the vicinity of the nozzle openings from drying.

The capping means 9 also has a function as an ink receptacle at the flushing operation time. That is, in this kind of record apparatus, to prevent ink in the vicinity of the nozzle openings from drying, ink droplets are ejected independently of print data, thereby performing the flushing operation of discharging ink increased in viscosity. In the capping means 9, the ink droplets ejected by performing the flushing operation are received in the inner space of the cap member 9*a*.

A pump unit 10 for sucking ink is placed contiguous with the capping means 9. The pump unit 10 uses a paper feed motor 33 for transporting record paper 6 (see FIG. 2) as a drive source and functions as a kind of suction pump of the invention together with the paper feed motor 33. The pump unit 10 is implemented as a tube pump unit for pushing and squeezing a flexible tube by a roller, thereby downstream sending air and ink in the tube, for example. The pump unit 10 is attached to a midway point of a liquid waste tube (not shown). The liquid waste tube has one end made to communicate with the inner space (negative pressure hollow part) of the cap member 9*a* and an opposite end made to communicate with a liquid waste tank (not shown). Thus, the pump unit 10 functions as negative pressure applying means for applying a negative pressure in the inner space of the cap member 9*a*.

If the pump unit 10 is actuated at the flushing operation time mentioned above, ink discharged to the cap member 9*a* can be sent to the liquid waste tank. If the pump unit 10 is actuated with the cap member 9*a* sealing the nozzle formation face, a negative pressure is applied in the inner space of the cap member 9*a*, so that ink in the record head 12 can be sucked through the nozzle openings. Accordingly, the ink in the record head 12 can be discharged to the outside of the recording head. Therefore, it can be said that the capping means 9 and the pump unit 10 also have a function as cleaning means.

When the capping means 9 moves in the up and down direction, the driving force of the paper feed motor 33 is used. Therefore, the capping means 9 and the pump unit 10 share the drive source.

As shown in FIG. 3, a wiping member 11 is provided on the upper end face of the capping means 9 (cap holder 9*b*) on the print area side. The wiping member 11 is a member for wiping the nozzle formation face of the record head 12. As a cam member 91 (see FIG. 5) advances, the wiping member 11 moves up together with the capping means 9 and as the cam member 91 retreats, the wiping member 11 moves down together with the capping means 9.

Figure 2:
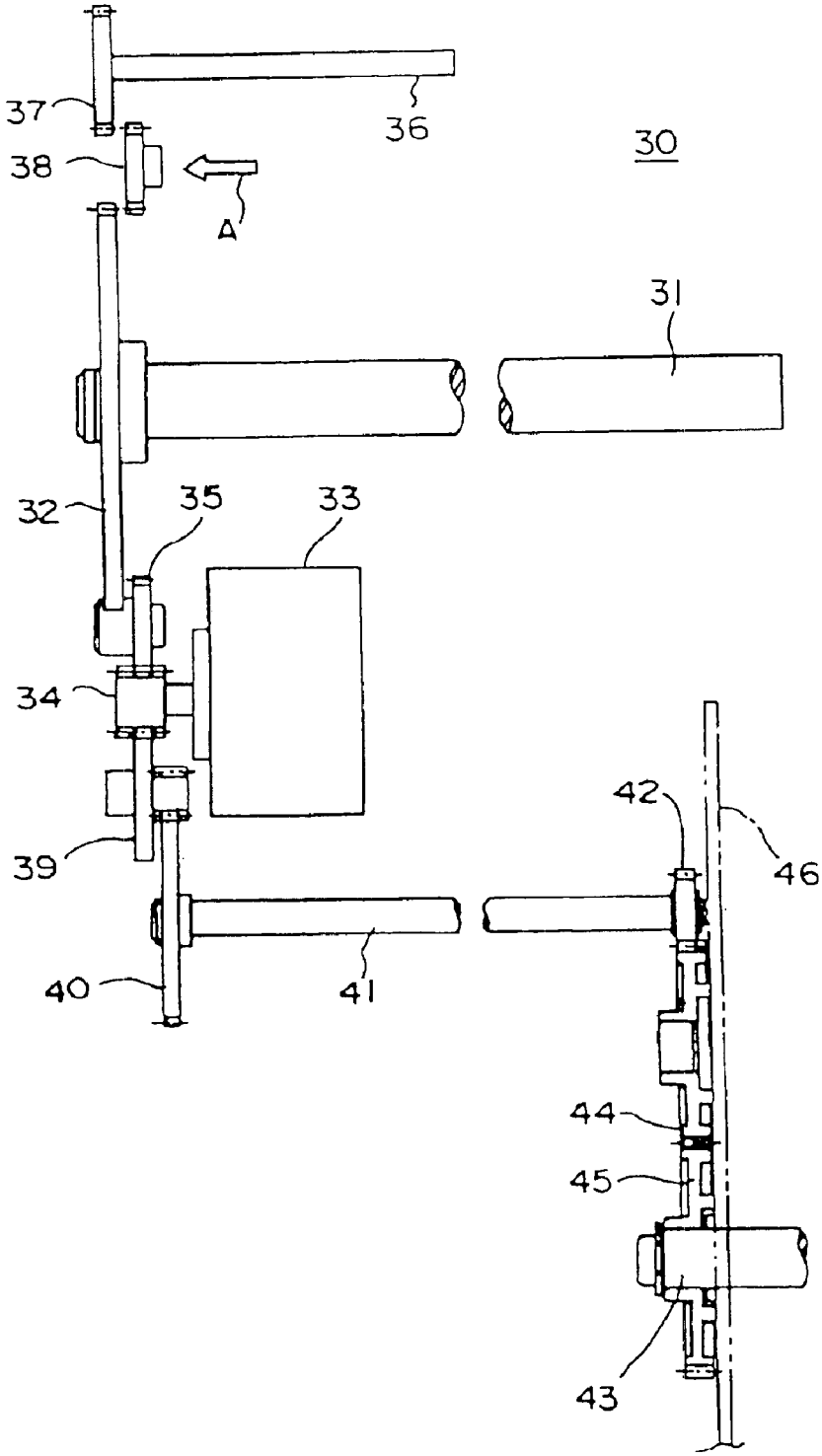
FIG. 2 is a sectional view to show a drive transmit unit of capping drive means.

Next, the capping means 9 and drive means of the capping means 9 (which will be hereinafter referred to as capping drive means) will be discussed in detail with reference to FIGS. 2 to 13. FIG. 2 is a sectional view to show a drive transmit unit 30 of the capping drive means. FIGS. 3 to 9 are perspective views to show the drive transmit unit 30 of the capping drive means and a driven transmit unit (driven transmit unit) thereof. FIGS. 10 to 13 are perspective views to show an intermediate transmit unit 71 of the capping drive means.

The capping means 9 includes at least the cap member 9*a*, the cap holder 9*b*, and a hold frame 9*e*. The capping drive means is means for moving the capping means 9 in the up and down vertical direction; in the embodiment, the capping drive means includes the paper feed motor 33 as a drive source, the drive transmit unit 30, the intermediate transmit unit 71, and the driven transmit unit (guide unit).

To begin with, the capping means 9 will be discussed based on FIGS. 3 to 9. As shown in the figures, the capping means 9 has the cap member 9*a* capable of sealing the nozzle formation face of the record head 12 and the cap holder 9*b* for holding the cap member 9*a*. The capping means 9 can be moved to a move-up position (FIG. 8, FIG. 9) and a move-down position (FIG. 4, FIG. 5) by the driving force from the drive transmit unit 30. The move-up position corresponds to the nozzle formation face seal position of the cap member 9*a* and the move-down position corresponds to the retreat position of the cap member 9*a*.

The cap member 9*a* is a box shaped roughly like a rectangle viewed from a flat face and in particular is a member shaped like a tray with the top opened; the whole is made of an elastic material of an elastomer, etc., for example. The cap member 9*a* is formed integrally with the cap holder 9*b* by two-color molding (double mold), for example. Alternatively, the cap member 9*a* and the cap holder 9*b* may be produced separately and then be joined. The cap member 9*a* and the cap holder 9*b* are formed in one piece as in the embodiment, whereby trouble of the cap member 9*a* being detached from the cap holder 9*b* can be prevented and the reliability of the apparatus can be maintained over a long term.

An ink absorption sheet (not shown) is housed in the inner space of the cap member 9*a* and can absorb and temporarily hold ink from the record head 12. The inner space of the cap member 9*a* communicates with the liquid waste tank through the liquid waste tube having flexibility (not shown) and the pump unit 10 is disposed at a midpoint in the liquid waste tube, as mentioned above.

On the other hand, the cap holder 9*b* is a box shaped roughly like a rectangle viewed from a flat face and is formed of a harder material (resin) than the elastomer of the material of the cap member 9*a*. In the end part of the cap holder 9*b* on the print area side, a pair of capping guides 9*d* positioned on both sides of a long edge portion and projecting in a state in which it is a little spread upward is placed in one piece.

The capping means 9 has the hold frame 9*e* (a kind of hold member) almost angular U-shaped in cross section for holding the cap holder 9*b*. Hold holes (not shown) opened in the move direction of the record head 12 (in the embodiment, horizontal direction) are made in both end parts of the hold frame 9*e*. A support shaft 9*c* is supported in the hold holes for rotation. That is, the hold frame 9*e* is held by the support shaft 9*c*. Therefore, it can be said that the cap member 9*a* is held indirectly by the support shaft 9*c* through the cap holder 9*b* and the hold frame 9*e*.

The support shaft 9*c* is formed of a round bar extending in the move direction of the record head 12. The hold member is not limited to the hold frame 9*e* and may be any if it can hold the cap member 9*a* and can support the support shaft 9*c* for rotation.

A fixed frame 21 is disposed in a proximity state so as to surround the hold frame 9*e* in the outside from the hold frame 9*e*. The fixed frame 21 is implemented as a plate member shaped roughly like angular U viewed from a flat face. Long holes 21*a* extending in the up and down vertical direction are made in both side parts of the fixed frame 21, and both end parts of the support shaft 9*c* are inserted in the long holes 21*a*. Racks 102*a* and 103*a* extending in the up and down direction along the long holes 21*a* (see FIGS. 4 and 5) are disposed in both side parts of the fixed frame 21.

Next, the capping drive means will be discussed. The capping drive means in the embodiment is made up of the drive source, the drive transmit unit 30, the intermediate transmit unit 71, and the driven transmit unit as mentioned above and therefore the "drive transmit unit," the "intermediate transmit unit," and the "driven transmit unit" will be discussed separately.

To begin with, the "drive transmit unit" will be discussed. As shown in FIG. 2, the drive transmit unit 30 functions as driving force transmit means common to a paper ejection mechanism, the pump unit 10, and the capping means 9. To move the capping means 9, the drive transmit unit 30 transmits a driving force (rotation force) from the paper feed motor 33, a kind of drive source of the invention, to the intermediate transmit unit 71.

The drive transmit unit 30 has the paper feed roller 31. A gear 32 is provided at one end of the paper feed roller 31 and is driven through an intermediate gear 35 from a pinion 34 provided on the shaft of the paper feed motor 33. A gear 37 is provided at one end of a paper feed roller drive shaft 36 and meshes with the gear 32 via a move gear 38 implementing a clutch mechanism and transmits power to a cut sheet feeder (not shown). Record paper 6 is fed (loaded) by the transmitted power.

On the other hand, power from the paper feed motor 33 is transmitted to the pinion 34, an intermediate gear 39, and a paper ejection roller gear 40 on a paper ejection roller 41. Further, power from the paper ejection roller gear 40 is transmitted via a gear 42 on the paper ejection roller 41, an intermediate gear 44, and a driven gear 45 to a drive shaft 43. When the power is transmitted to the drive shaft 43, the pump unit 10 is driven. That is, the power from the paper feed motor 33 is transmitted via the paper ejection roller 41 and the drive shaft 43 to the intermediate transmit unit 71.

The pump unit 10 has a pump frame 53 mounted to a fix base (attachment base) 46, as shown in FIG. 3. The drive shaft 43 is rotatably supported by the fix base 46 and the pump frame 53. The fix base 46 is formed with a guide hole 46*a* extending in the advance and retreat direction (move direction) of a cam member 91.

Next, the "intermediate transmit unit 71" will be discussed. The intermediate transmit unit 71 has a planet gear mechanism 81 and the cam member 91, as shown in FIGS. 10 to 13. The intermediate transmit unit 71 is disposed between the fix base 46 and the pump frame 53 for transmitting the driving force from the drive transmit unit 30 to the driven transmit unit.

The planet gear mechanism 81 includes the drive shaft (pump shaft) 43 having a sun gear 72 and a drive lever 73 and a hold lever 74 attached to the drive shaft 43 in a rotatable state.

The drive lever 73 has an annular base part 73*a* in which the drive shaft 43 is inserted and a lever part 73*b* shaped like a flap piece extending to the outside from the base part 73*a*. The drive lever 73 is disposed at a position opposite to the pump unit 10 in the hold lever 74 and is supported rotatably within a predetermined rotation stroke relative to the drive shaft 43. A cylindrical drive pin 75 projecting to the pump side (horizontal direction) is integral with the lever part 73*b* of the drive lever 73. An extension part 76 shaped like a fan on a flat face projected to the opposite side to the lever part 73*b* and having a rising wall 76*a* in an outer peripheral margin is integral with the base part 73*a* of the drive lever 73. The rising wall 76*a* of the extension part 76 is formed with an internal gear 77 along the circumferential direction.

The hold lever 74 has an annular base part (not shown) in which the drive shaft 43 is inserted and lever parts 74*b* and 74*c* each shaped like a rectangular piece projected in the radial direction of the base part. The hold lever 74 is supported rotatably between two positions in the rotation direction relative to the drive shaft 43. The lever part 74*b* is formed with stopper engagement parts 74C and 74D. The stopper engagement parts 74C and 74D are parts that can be engaged with both stoppers 53*c* and 53*d* placed parallel with each other with a predetermined spacing in the circumferential direction of the pump frame. A planet gear 78 is held on the lever part 74*c* for rotation in a state in which it meshes with the sun gear 72. The planet gear 78 can mesh with the internal gear 77 of the drive lever 73.

At least the lever part 74*c* of both the lever parts 74*b* and 74*c* is formed as an elastic rod part so that it can become elastically deformed upon reception of an external force produced as the drive lever 73 rotates in a state in which the stopper engagement part 74C, 74D is engaged with the stopper 53*c*, 53*d*. Accordingly, when rotation of the hold lever 74 stops and the drive lever 73 rotates, shock accompanying the mesh of the planet gear 78 and the internal gear 77 is absorbed.

On the other hand, the cam member 91 is joined to the planet gear mechanism 81 (drive pin 75) and is disposed on the fix base 46 (FIG. 3) in a state in which it can advance and retreat, as shown in FIGS. 10 to 13. The cam member 91 is formed with a convex part 91*a* that can slide in the guide hole 46*a*. Accordingly, the cam member 91 can be moved in the horizontal direction at right angles to the move direction of the record head 12. The cam member 91 is formed with a first long hole 92 and a second long hole 93 in a state in which the holes pierce the plate thickness direction, as shown in FIGS. 5, 7, 9, and 10 to 13.

The first long hole 92 has horizontal parts 92*a* to 92*c* and tilt parts 92*d* and 92*e* for guiding the support shaft 9*c*. The horizontal part 92*a* is placed in a low part of the first long hole 92 and the horizontal part 92*b* is placed in a high part of the first long hole 92. The horizontal part 92*c* is placed in an intermediate part of the first long hole 92 (namely, between the horizontal parts 92*a* and 92*b* in the height direction). The horizontal parts 92*a* to 92*c* are formed of a hole parallel with the advance direction of the cam member 91, namely, a hole extending in the horizontal direction from the advance position of the cam member 91 to the retreat position. The horizontal part 92*a* holds the support shaft 9*c* in the retreat state of the cam member 91 (capping release state) and the horizontal part 92*b* holds the support shaft 9*c* in the advance state of the cam member 91 (capping state). The horizontal part 92*c* holds the support shaft 9*c* in the wiping state.

The tilt part 92*d* is placed between the horizontal parts 92*a* and 92*c*, and the tilt part 92*e* is placed between the horizontal parts 92*c* and 92*b*. The tilt parts 92*d* and 92*e* are formed of a hole having an upward slope from the advance position of the cam member 91 to the retreat position. The tilt part 92*d* gives the support shaft 9*c* a moving up and down force from the retreat position to a wiping position at the wiping time or the capping time. The tilt part 92*e* gives the support shaft 9*c* a moving up and down force from the wiping position to the capping position at the capping time.

The second long hole 93 is placed to the pump unit 10 side from the first long hole 92. The second long hole 93 is a hole extending in the up and down direction for guiding the drive pin 75 in the up and down direction.

Next, the "driven transmit unit" will be discussed. The driven transmit unit joined to the intermediate transmit unit 71 has a pair of rack-pinion mechanisms 102 and 103 and the support shaft 9*c*, as shown in FIGS. 4 to 9. One rack-pinion mechanism 102 is disposed on one side of the fixed frame 21 (non-print area side portion) and the other rack-pinion mechanism 103 is disposed on another side of the fixed frame 21 (print area side portion). Both the rack-pinion mechanisms 102 and 103 are placed at symmetrical positions in the fixed frame 21.

The support shaft 9*c* is disposed between the rack-pinion mechanisms 102 and 103. A non-print side end part of the support shaft 9*c* is inserted into a pinion 102*b* forming a part of the rack-pinion mechanism 102 and is fixedly secured. The insertion end part is held rollably in the first long hole 92 of the cam member 91. Accordingly, as the cam member 91 advances and retreats, the support shaft 9*c* rolls in the first long hole 92. Therefore, the rolling force (rotation force) is transmitted from one rack-pinion mechanism 102 to the other rack-pinion mechanism 103.

The rack-pinion mechanism 102 has a rack 102*a* and the pinion 102*b*. The rack 102*a* extends in the up and down vertical direction and projects to the end part of the non-print area side in the fixed frame 21. The pinion 102*b* is fixedly secured to the non-print area end part of the support shaft 9*c* and meshes with the rack 102*a*. On the other hand, the rack-pinion mechanism 103 has a rack 103*a* and a pinion 103*b*. In the rack-pinion mechanism 103, the rotation force from the rack-pinion mechanism 102 (namely, the support shaft 9*c*) is received at the print area side end part of the hold frame 9*e* and the pinion 103*b* is rolled along the rack 103*a* by the rotation force. The rack 103*a* and the pinion 103*b* of the rack-pinion mechanism 103 have the same configuration as the rack 102*a* and the pinion 102*b* of the rack-pinion mechanism 102 and therefore will not be discussed again in detail.

The support shaft 9*c* is supported on the hold frame 9*e* (hold hole) for rotation as described above and is inserted and held in the long holes 21*a* of the fixed frame 21 in a state in which it can rotate and move up and down. Thus, when the support shaft 9*c* receives a move-up or move-down force from the cam member 91 and moves up or down in the long hole 21 *a* of the fixed frame 21, the support shaft 9C is guided by the rack-pinion mechanism 102, 103. The cap holder 9*b* (cap member 9*a*) is moved up or down while the state in which the seal face of the cap member 9*a* and the nozzle formation face of the record head 12 are parallel is maintained.

Figure 4:
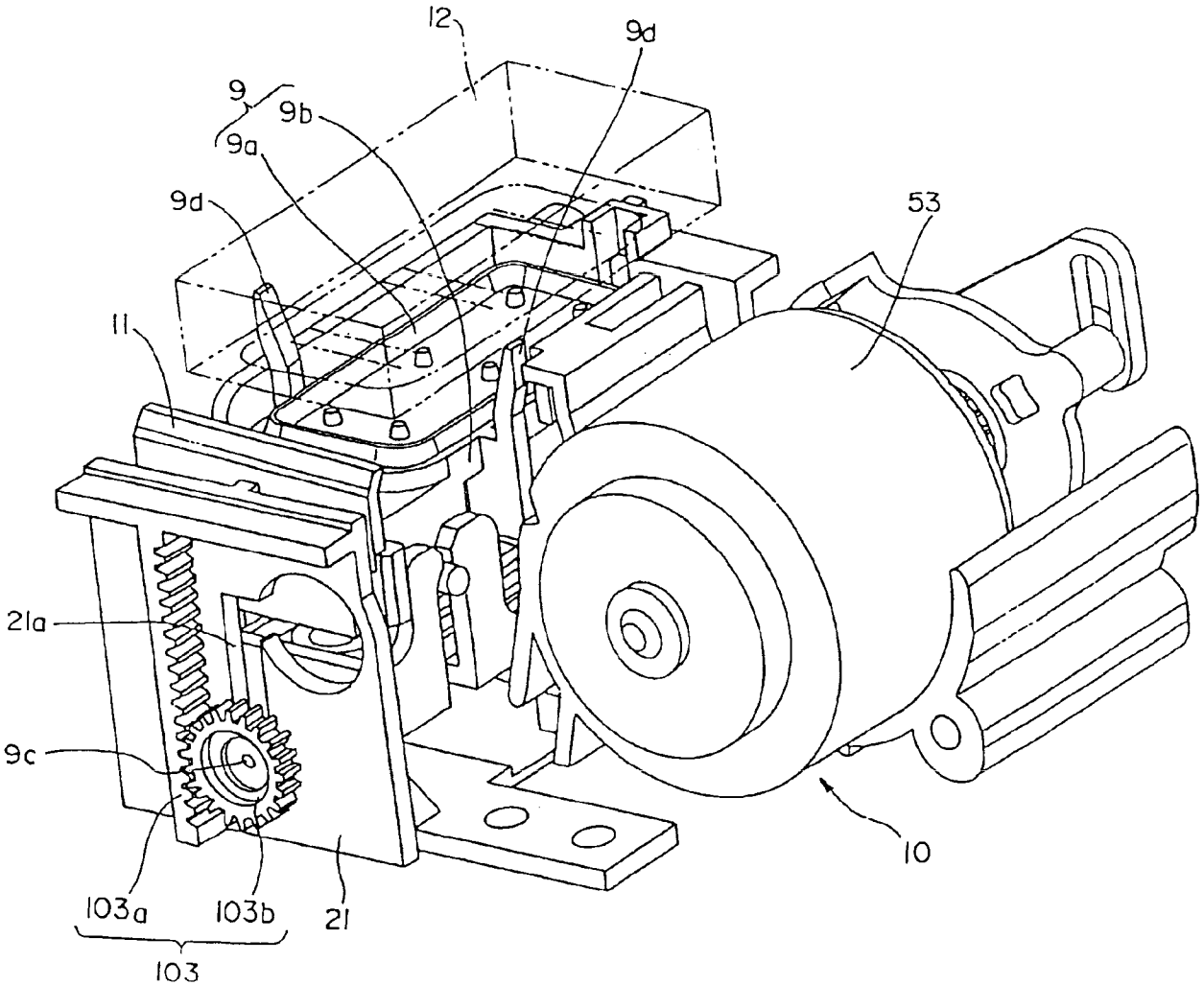
FIG. 4 is a perspective view of a retreat state of capping means viewed from a print area side.
Figure 5:
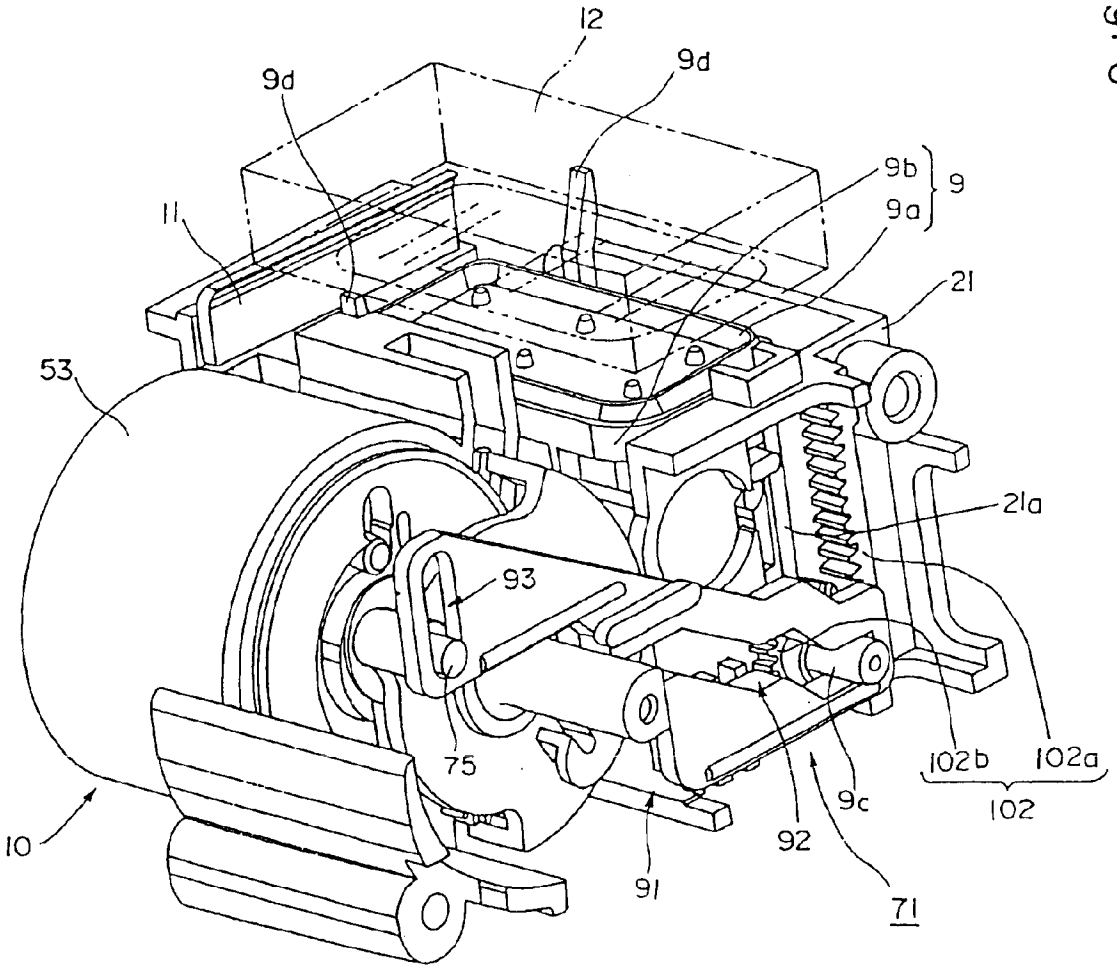
FIG. 5 is a perspective view of the retreat state of the capping means viewed from a non-print area side.
Figure 10:
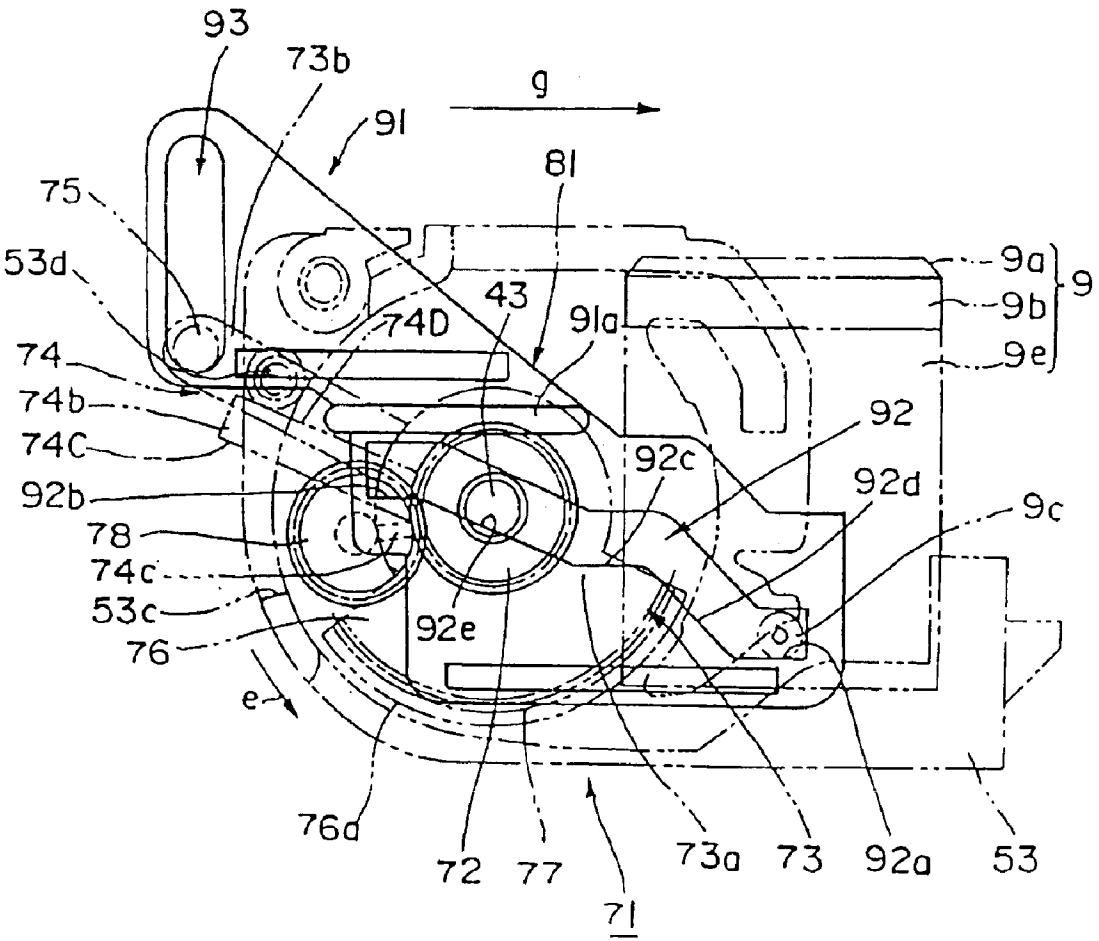
FIG. 10 is a perspective view to show the retreat state of the capping means.

In the described configuration, when the sun gear 72 (drive shaft 43) receives the driving force from the drive transmit unit 30 (paper feed motor 33) from the reset (retreat) state shown in FIGS. 4, 5, and 10 and starts to rotate in the forward direction (counterclockwise), the rotation force is transmitted via the planet gear 78 to the hold lever 74. The hold lever 74 rotates counterclockwise (arrow e direction in FIG. 10). When the hold lever 74 rotates in the arrow e direction, the stopper engagement part 74D is brought away from the stopper 53*d*.

Since the mesh of the planet gear 78 and the internal gear 77 is released in the rotation start state of the sun gear 72, the drive lever 73 does not receive the driving force from the sun gear 72 and remains stopped at the rotation start position as shown in FIG. 10. The drive pin 75 and the support shaft 9*c* are positioned at the start end part (lower end part) of the second long hole 93 and the horizontal part 92*a* of the first long hole 92 respectively.

If the sun gear 72 still more rotates counterclockwise, the hold lever 74 further rotates counterclockwise (arrow e direction). In this case, the planet gear 78 meshes with the internal gear 77 and moves counterclockwise on the internal gear 77 while rotating clockwise. Thus, the drive lever 73 does not rotate clockwise (direction in which the cam member 91 is advanced) until the stopper engagement part 74C engages with the stopper 53*c*. If the hold lever 74 further rotates, the stopper engagement part 74C engages with the stopper 53*c* and thus the hold lever 74 stops at a rotation stop position on one side. If the sun gear 72 further rotates counterclockwise in this state, namely, with the stopper engagement part 74C engaging with the stopper 53*c*, the planet gear 78 rotates clockwise and the drive lever 73 starts to rotate clockwise.

In this case, the rotation force from the sun gear 72 is transmitted via the planet gear 78 to the hold lever 74, but the stopper engagement part 74C of the lever part 74*b* engages with the stopper 53*c* and thus the hold lever 74 does not rotate counterclockwise (arrow e direction). Thus, when the rotation force from the sun gear 72 is transmitted via the planet gear 78 to the hold lever 74, the lever part 74*c* bends in a direction in which it approaches the lever part 74*b*.

If the sun gear 72 further rotates counterclockwise, the planet gear 78 further rotates clockwise and the drive lever 73 also rotates clockwise. In this case, when the drive lever 73 rotates clockwise, the lever part 73*b* also rotates in the same direction and thus the cam member 91 receives the rotation force as an advance force and moves in the arrow g direction from the retreat position shown in FIG. 10 to the advance position. As the cam member 91 moves, the support shaft 9*c* receives a rotation force and a move-up force from the cam member 91, namely, the tilt part 92*d* of the first long hole 92. Thus, the support shaft 9*c* moves up while rotating counterclockwise on the tilt part 92*d*, and the pinions 102*b* and 103*b* roll upward along the racks 102*a* and 103*a*. As the pinions 102*b* and 103*b* roll, the wiping member 11 advances from the outside of a move path of the record head 12 to the wiping position in the move path together with the hold frame 9*e* (moves upward in the vertical direction).

Figure 6:
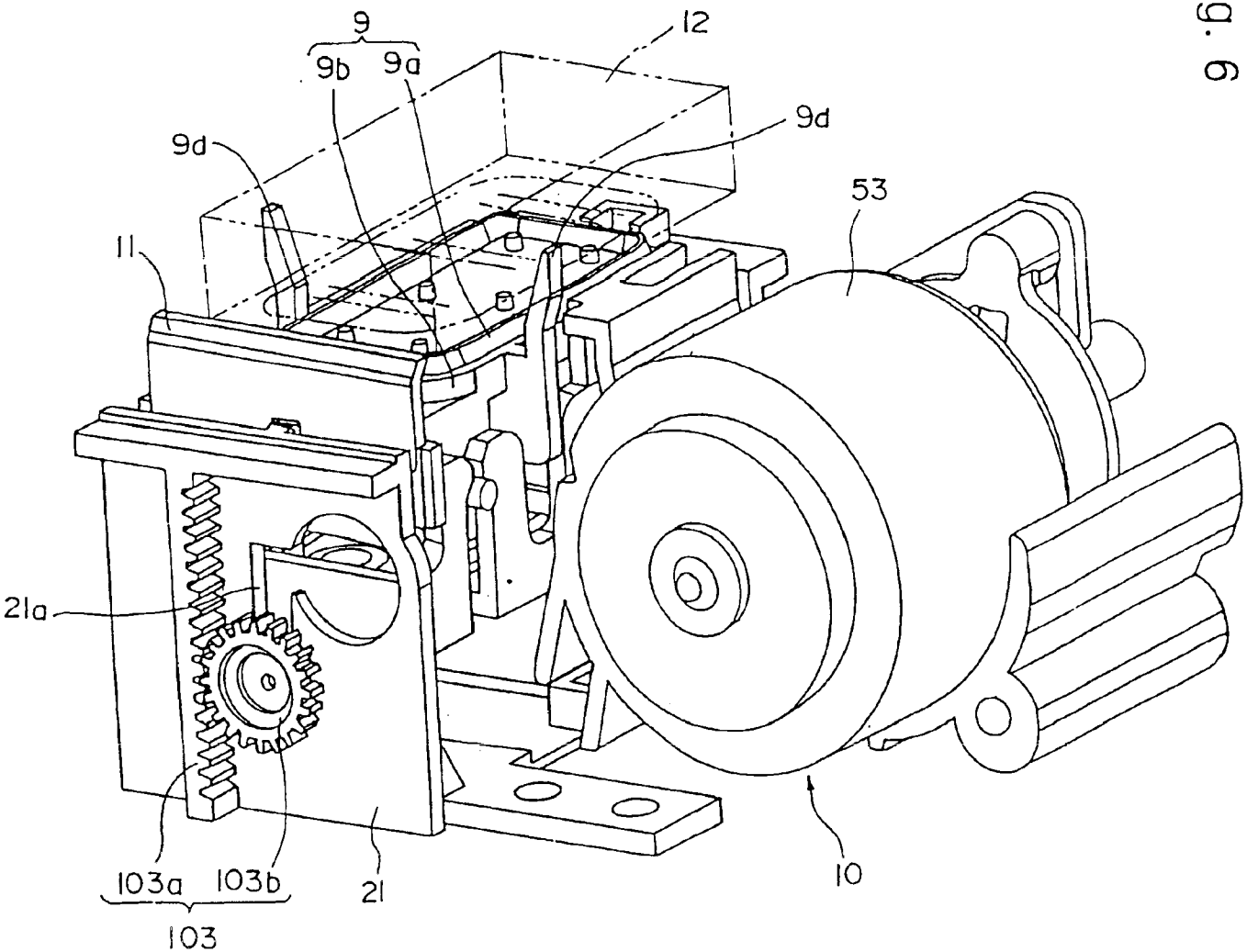
FIG. 6 is a perspective view of a wiping state of a wiping member viewed from the print area side.
Figure 7:
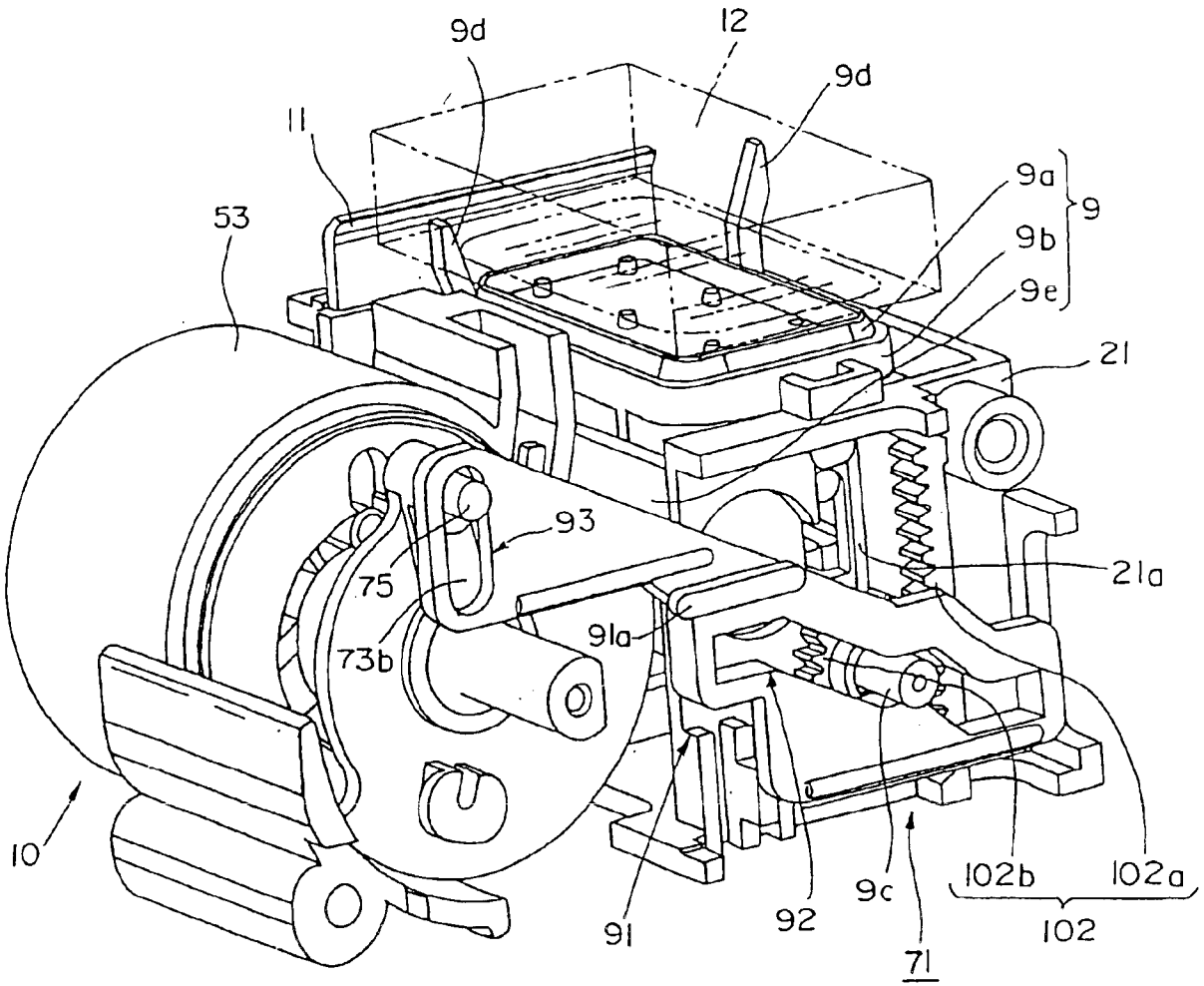
FIG. 7 is a perspective view of the wiping state of the wiping member viewed from the non-print area side.
Figure 11:
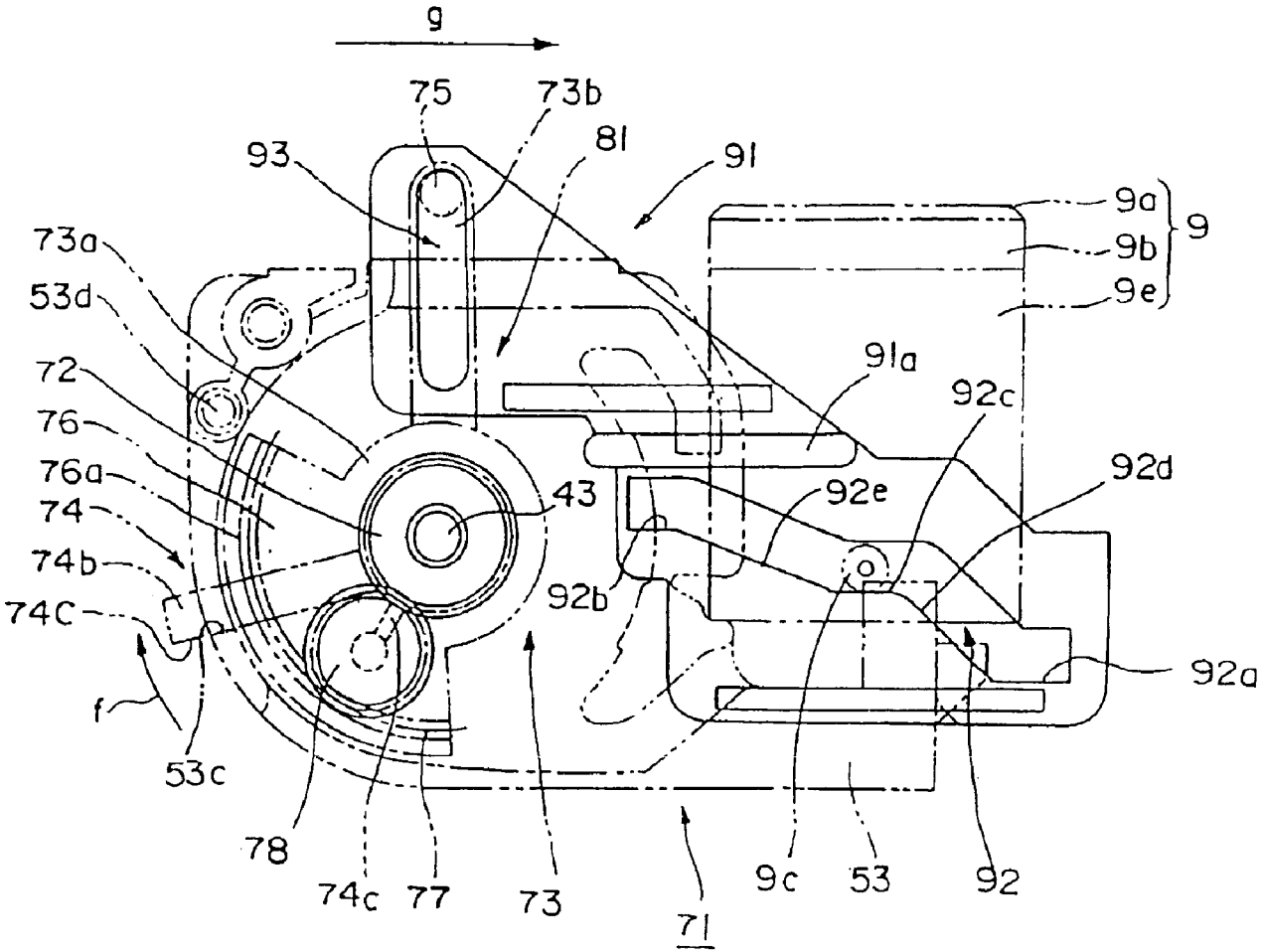
FIG. 11 is a perspective view to show the wiping state of the wiping member.

If the support shaft 9*c* runs onto the horizontal part 92*c* from the tilt part 92*d*, the wiping member 11 arrives at the wiping position, as shown in FIGS. 6, 7, and 11. If the record head 12 is moved to the non-print area side at the wiping position, the nozzle formation face is wiped. When the wiping member 11 moves up from the retreat position shown in FIG. 10 to the wiping position, the drive pin 75 moves from the start end part (lower end part) of the second hole 93 and is positioned at the termination part (upper end part).

After this, if the sun gear 72 further rotates counterclockwise, the planet gear 78 further rotates clockwise and the drive lever 73 also rotates clockwise (arrow f direction) accordingly. In this case, when the drive lever 73 rotates clockwise, the lever part 73*b* also rotates in the same direction and thus the cam member 91 moves in the arrow 9 direction from the position shown in FIG. 11 to the advance position. As the cam member 91 moves, the support shaft 9*c* receives a move-up force from the cam member 91, namely, the tilt part 92*e* of the first long hole 92.

Thus, the support shaft 9*c* moves up while rotating clockwise on the tilt part 92*e*, and the pinions 102*b* and 103*b* roll upward in the vertical direction while they are guided along the racks 102*a* and 103*a*. As the pinions 102*b* and 103*b* roll, the capping means 9 advances, namely, moves up from the wiping position to the capping position (nozzle formation face seal position). If the support shaft 9*c* runs onto the horizontal part 92*b* from the tilt part 92*e*, the cap member 9*a* arrives at the capping position and the capping means 9 (cap member 9*a*) seals the nozzle formation face of the record head 12 at the capping position, as shown in FIGS. 8, 9, and 12.

Figure 12:
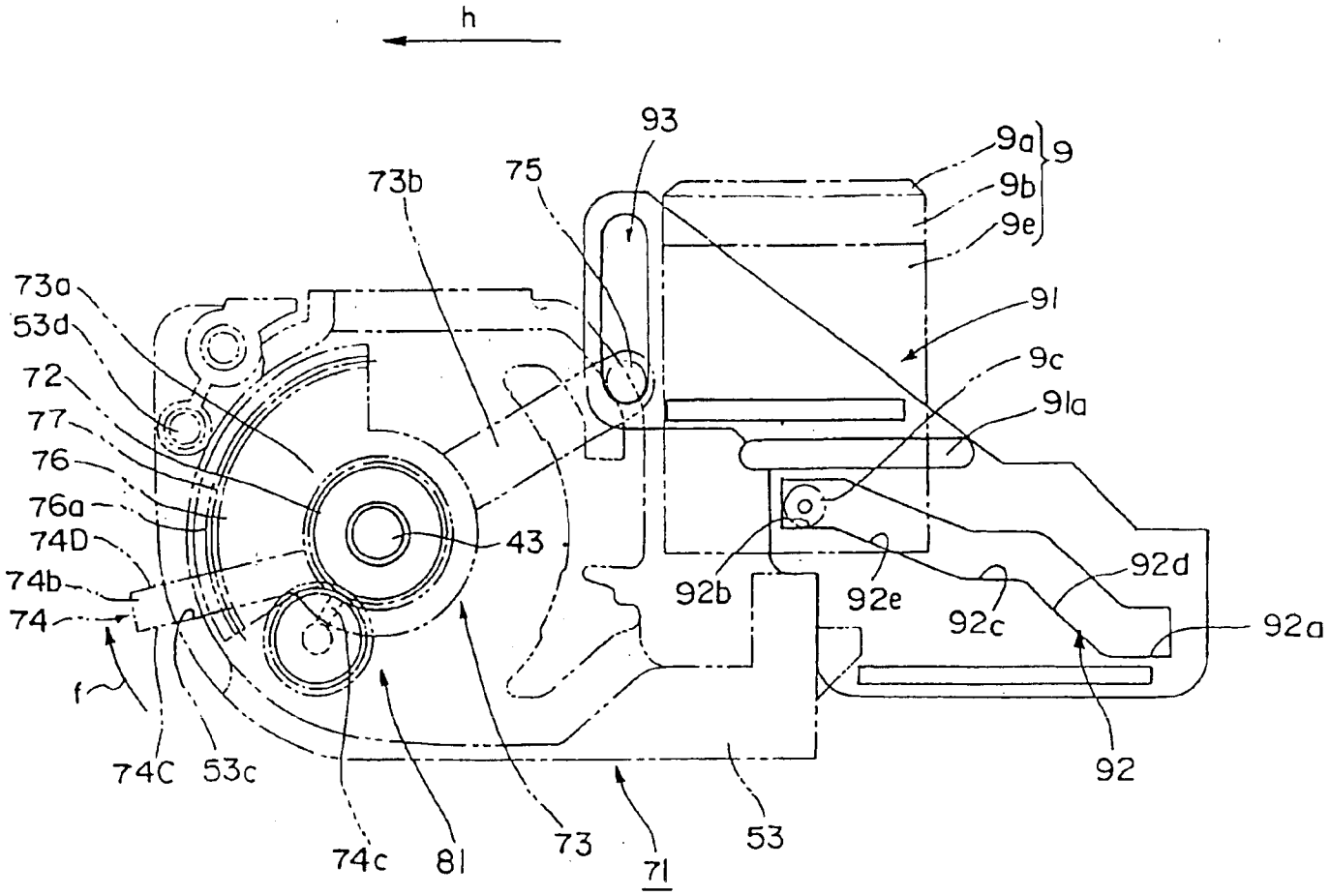
FIG. 12 is a perspective view to show the capping state of the capping means.

When the capping means 9 arrives at the capping position, the lever part 74*c* of the hold lever 74 is elastically restored and the mesh of the planet gear 78 and the internal gear 77 is released, as shown in FIG. 12. Thus, the drive lever 73 does not receive the driving force from the sun gear 72 and is placed at a rotation end position. The drive pin 75 moves from the termination part (upper end part) of the second long hole 93 and is positioned at the start end part (lower end part).

Figure 8:
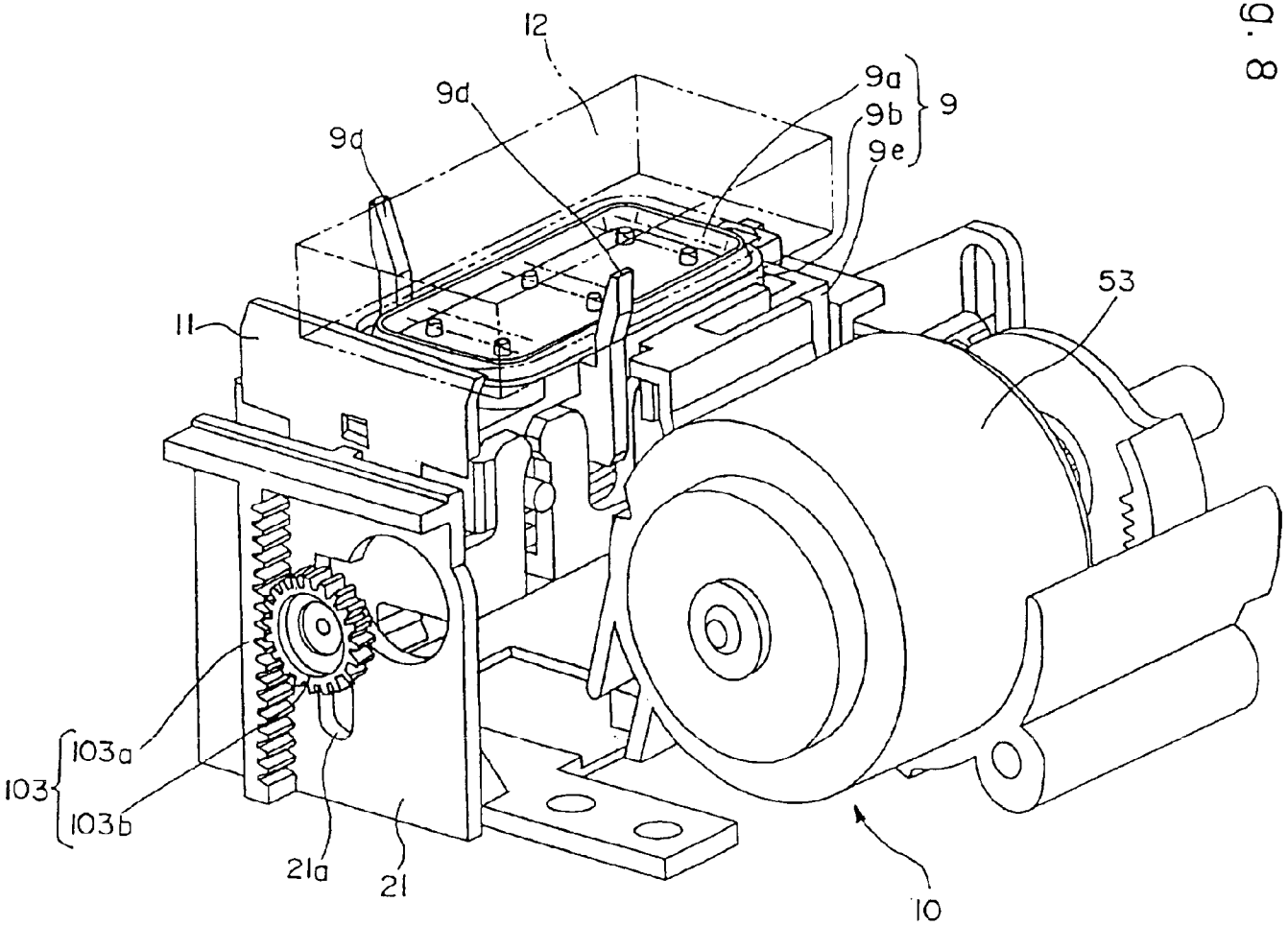
FIG. 8 is a perspective view of a capping state of the capping means viewed from the print area side.
Figure 9:
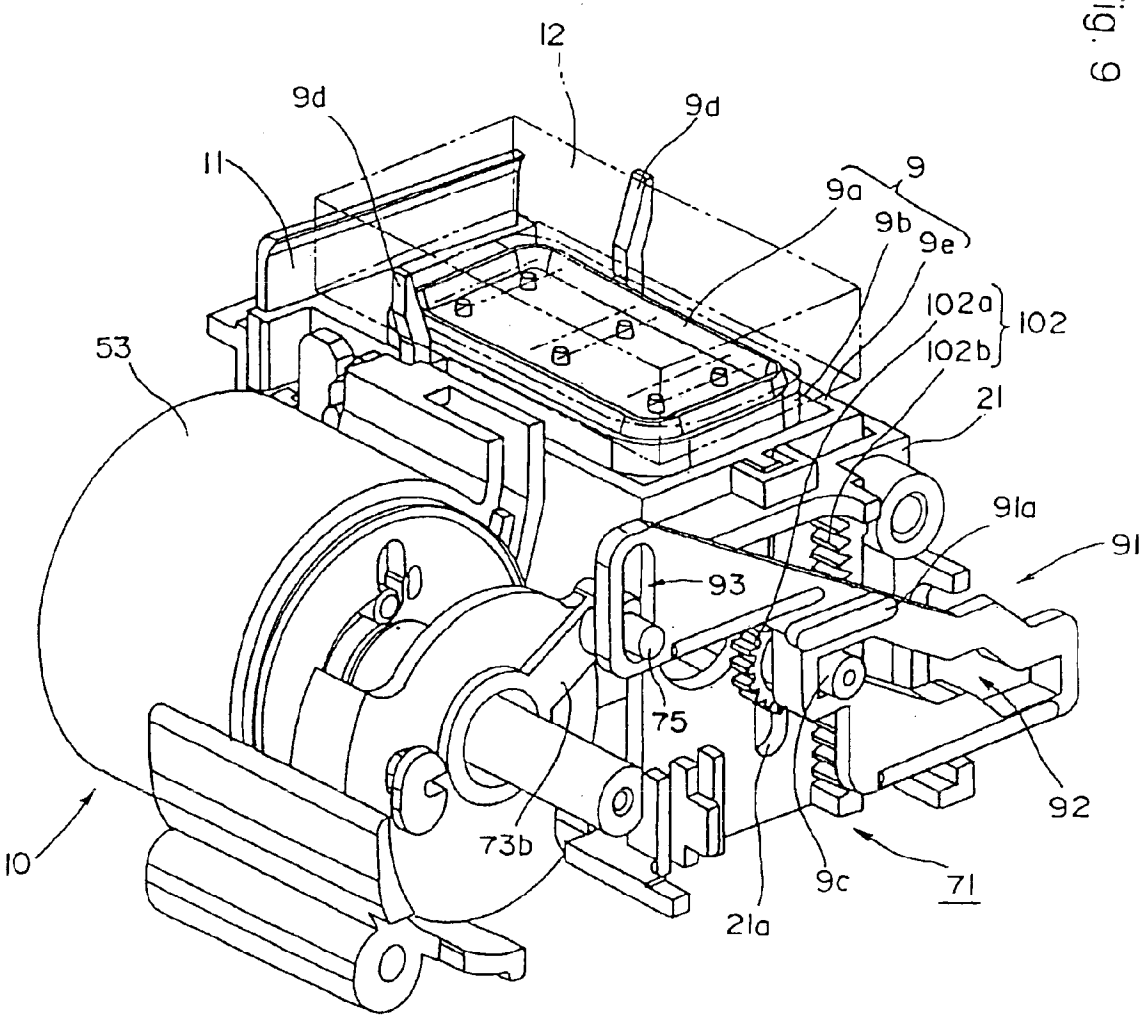
FIG. 9 is a perspective view of the capping state of the capping means viewed from the non-print area side.

On the other hand, if the sun gear 72 (drive shaft 43) receives the driving force from the drive transmit unit 30 (paper feed motor 33) from the reset state shown in FIGS. 8, 9, and 12 and starts to rotate in the opposite direction (clockwise), the rotation force is transmitted via the planet gear 78 to the hold lever 74 and the hold lever 74 rotates clockwise (arrow f direction in FIG. 12). In this case, when the hold lever 74 rotates in the arrow f direction, the stopper engagement part 74C is brought away from the stopper 53*c*.

Since the mesh of the planet gear 78 and the internal gear 77 is released in the rotation start state of the sun gear 72, the drive lever 73 does not receive the driving force from the sun gear 72 and remains stopped at the rotation end position as shown in FIG. 12. The drive pin 75 and the support shaft 9*c* are positioned at the start end part (lower end part) of the second long hole 93 and the horizontal part 92*b* of the first long hole 92 respectively.

If the sun gear 72 still more rotates clockwise, the hold lever 74 further rotates clockwise (arrow f direction). As the hold lever 74 rotates, the planet gear 78 meshes with the internal gear 77 and moves clockwise on the internal gear 77 while rotating counterclockwise. Thus, the drive lever 73 does not rotate counterclockwise (direction in which the cam member 91 is retreated) until the stopper engagement part 74D engages with the stopper 53*d*.

If the hold lever 74 further rotates, the stopper engagement part 74D engages with the stopper 53*d* and thus the hold lever 74 stops at a rotation stop position on an opposite side. If the sun gear 72 further rotates clockwise in this state, namely, with the stopper engagement part 74D engaging with the stopper 53*d*, the planet gear 78 rotates counterclockwise and the drive lever 73 starts to rotate counterclockwise. In this case, the rotation force from the sun gear 72 is transmitted via the planet gear 78 to the hold lever 74, but the stopper engagement part 74D of the lever part 74*b* engages with the stopper 53*d* and thus the hold lever 74 does not rotate clockwise (arrow f direction). Thus, when the rotation force from the sun gear 72 is transmitted via the planet gear 78 to the hold lever 74, the lever part 74*c* bends in a direction in which it is brought away from the lever part 74*b*.

If the sun gear 72 further rotates clockwise, the planet gear 78 further rotates counterclockwise and the drive lever 73 also rotates counterclockwise. In this case, the lever part 73*b* also rotates in the same direction and thus the cam member 91 receives the rotation force as a retreat force and moves in the arrow h direction from the capping position (set position) shown in FIG. 12 to the retreat position. As the cam member 91 moves, the support shaft 9*c* receives a move-down force by gravitation.

Figure 13:
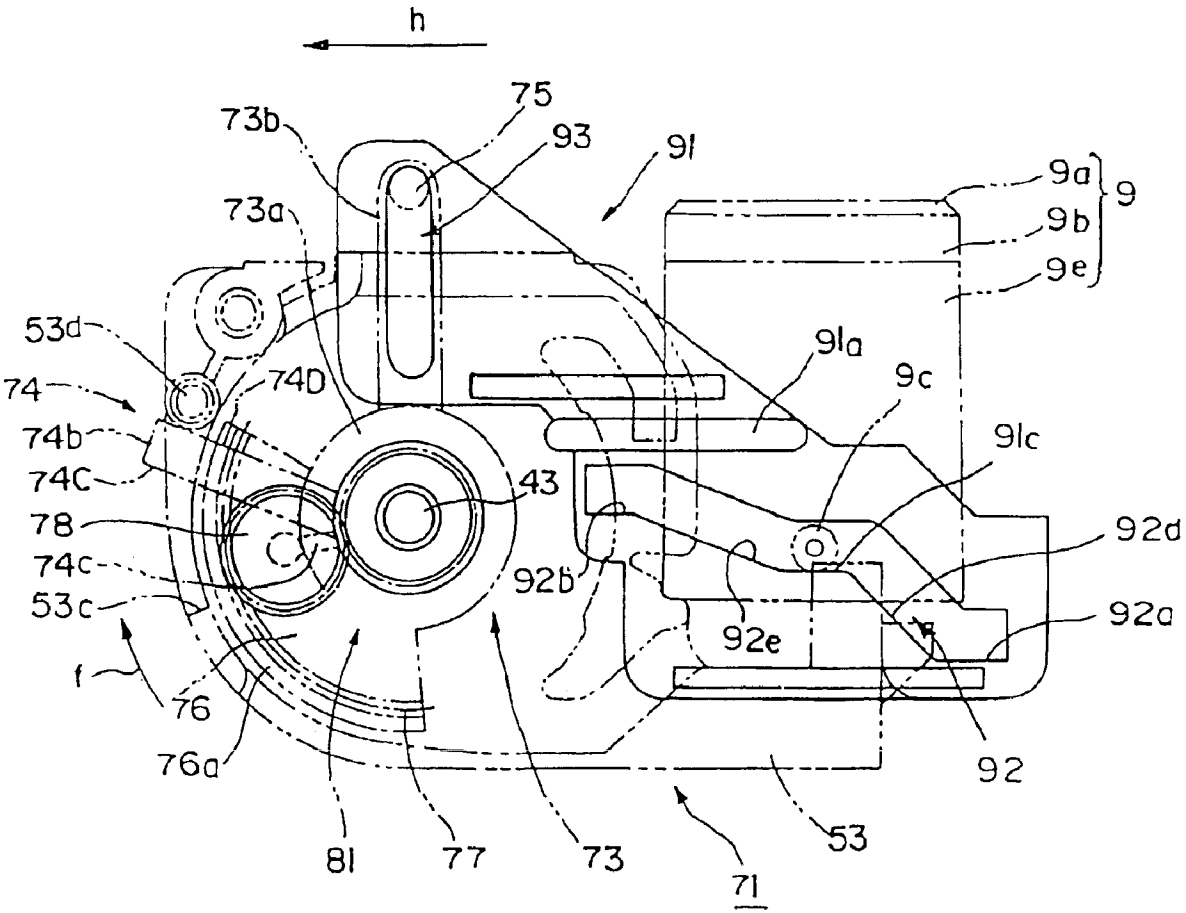
FIG. 13 is a perspective view to show the wiping state of the wiping member.
Figure 14:
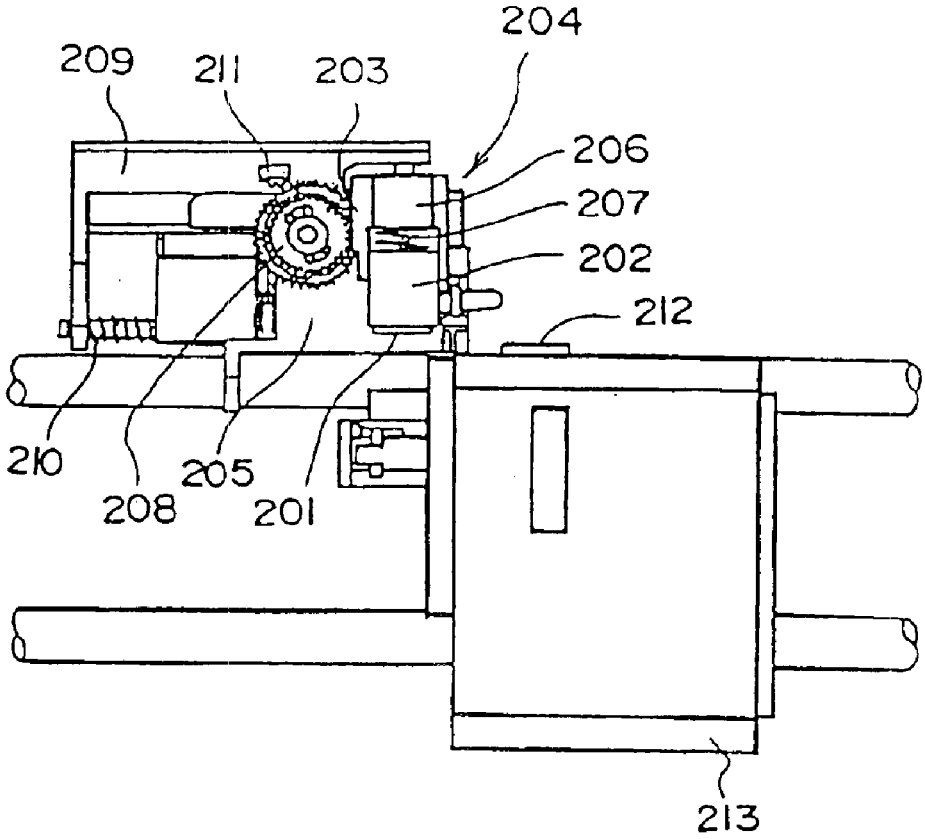
FIG. 14 is a schematic representation to show capping means in an apparatus in a related art.

Thus, the support shaft 9*c* moves down while rotating clockwise on the tilt part 92*e*, and the pinions 102*b* and 103*b* roll downward in the vertical direction along the racks 102*a* and 103*a*. As the pinions 102*b* and 103*b* roll, the wiping member 11 retreats, namely, moves down to the wiping position from the inside of the move path of the record head 12 to the outside of the move path together with the capping means 9, releasing the seal state of the nozzle formation face of the record head 12 at the capping position. If the wiping member 11 further moves down together with the capping means 9 and the support shaft 9*c* moves to the horizontal part 92*c* from the tilt part 92*e*, the wiping member 11 arrives at the wiping position, as shown in FIGS. 6, 7, and 13. If the record head 12 is moved to the print area side in this state, the nozzle formation face is wiped by the wiping member 11.

When the wiping member 11 moves down from the advance position shown in FIG. 12 to the wiping position, the drive pin 75 moves from the start end part (lower end part) of the second hole 93 and is positioned at the termination part (upper end part).

After this, if the sun gear 72 further rotates clockwise, the planet gear 78 further rotates counterclockwise and the drive lever 73 also rotates counterclockwise (arrow e direction). In this case, when the drive lever 73 rotates counterclockwise, the lever part 73*b* rotates in the same direction and thus the cam member 91 moves in the arrow h direction from the position shown in FIG. 13 to the retreat position. As the cam member 91 moves, the support shaft 9*c* receives a move-down force by gravitation.

Thus, the support shaft 9*c* moves down while rotating counterclockwise on the tilt part 92*d*, and the pinions 102*b* and 103*b* roll downward in the vertical direction while they are guided along the racks 102*a* and 103*a*, as shown in FIGS. 4, 5, and 10. As the pinions 102*b* and 103*b* roll, the capping means 9 retreats (moves down) from the position shown in FIG. 13 to the retreat position (reset position). If the support shaft 9*c* moves to the horizontal part 92*a* from the tilt part 92*d*, the capping means 9 arrives at the retreat position.

When the capping means 9 moves down to the reset position, the lever part 74*c* of the hold lever 74 is elastically restored and the mesh of the planet gear 78 and the internal gear 77 is released, as shown in FIG. 10. Thus, the drive lever 73 does not receive the driving force from the sun gear 72 and is placed at the rotation end position.

The drive pin 75 moves from the termination part (upper end part) of the second long hole 93 to the start end part (lower end part). Therefore, in the embodiment, as the cam member 91 advances, the capping means 9 moves up (moves upward in the vertical direction), whereby the nozzle formation face of the record head 12 is sealed. On the other hand, as the cam member 91 retreats, the capping means 9 moves down (moves downward in the vertical direction), whereby the seal state of the nozzle formation face of the record head 12 is released.

Accordingly, the capping means 9 is set and reset as the capping means 9 is moved up and down in the vertical direction. Thus, the move area of the capping means 9 can be reduced as much as possible and the whole apparatus can be miniaturized.

In the embodiment, the rack-pinion mechanisms 102 and 103 for guiding the support shaft 9*c* in the vertical direction are disposed on both sides of the capping means 9, so that the capping means 9 can be moved up and down so that the seal face of the cap member 9*a* and the nozzle formation face of the record head 12 become parallel with each other.

Further, in the embodiment, the wiping member 11 is placed in the cap holder 9*b*, so that the cap 9*a* and the cap holder 9*b* and the wiping member 11 can be molded of an elastomer, etc., in one piece. Thus, the cost can be reduced.

Further, in the embodiment, the fact that the cap 9*a* and the wiping member 11 can be molded in one piece means that the members 9*a* and 11 can be brought close to each other. Thus, the contamination area resulting from ink scattering can be reduced.

In addition, in the embodiment, the drive shaft 43 is implemented as the pump drive shaft of the pump unit 10. Accordingly, the rotation force of the pump drive shaft can be used as the driving force for moving the capping means 9 in the up and down direction. Consequently, the number of parts can be decreased.

In the embodiment, the second long hole 92 for guiding the support shaft 9*c* is formed with the horizontal parts 92*b* and 92*c*, so that the support shaft 9*c* is held on the horizontal parts 92*b* and 92*c*, making it possible to perform the wiping operation and the capping operation. Thus, the height of the cap member 9*a* is determined and the wiping operation and the capping operation can be performed reliably.

In the description of the embodiment, as the transmit mechanism for giving the advance and retreat forces to the cam member 91, the planet gear mechanism 81 is taken as an example, but the invention is not limited to it. That is, any other mechanism for giving the advance and retreat forces may be used. In this case, transmit of the driving force from the drive transmit unit 30 to the driven transmit unit is executed via the mechanism for giving the advance and retreat forces and the cam member 91 (not shown).

INDUSTRIAL APPLICABILITY

The invention can be applied to an image record apparatus that can eject ink droplets for recording text and an image on a print record medium, as mentioned above. In addition, the invention can also be applied to a filter manufacturing apparatus for ejecting color material onto a filter base material for manufacturing a color filter and a display manufacturing apparatus for ejecting liquid crystal, liquid electrode material, etc., onto a display base body surface for manufacturing various displays such as a liquid crystal display, an EL display, and an FED (face light emitting display). Further, the invention can also be applied to a biochip manufacturing apparatus used for manufacturing biochips and a micropipet for supplying an extremely small amount of liquid with good accuracy.

Description of Reference Numerals

1 Carriage
2 Carriage motor
3 Timing belt
4 Guide rod
6 Record paper
7 Black ink cartridge
8 Color ink cartridge
9 Capping means
  9*a* Cap member
  9*b* Cap holder
  9*d* Capping guide
  9*e* Hold frame
  9*c* Support shaft
10 Pump unit
11 Wiping member
12 Record head
21 Fixed frame
  21*a* Long hole
30 Drive transmit unit
31 Paper feed roller
32 Gear
33 Paper feed motor
34 Pinion
35 Intermediate gear
36 Paper feed roller drive shaft
37 Gear
38 Move gear
39 Intermediate gear
40 Paper ejection roller gear
41 Paper ejection roller
42 Gear
43 Drive shaft
44 Intermediate gear
45 Driven gear
46 Fix base
  46*a* Guide hole
53 Pump frame
  53*c* Stopper
  53*d* Stopper
71 Intermediate transmit unit
72 Sun gear
73 Drive lever
  73*a* Base part
  73*b* Lever part
74 hold lever
  74*b* Lever part
  74*c* Lever part
74*c* Stopper engagement part
74*d* Stopper engagement part
75 Drive pin
76 Extension part
  76*a* Rising wall
77 Internal gear
78 Planet gear
81 Planet gear mechanism
91 Cam member
  91 A convex part
92 First long hole
  92*a* Horizontal part
  92*b* Horizontal part
  92*c* Horizontal part
  92*d* Tilt part
  92*e* Tilt part
93 Second long hole
102 Rack-pinion mechanism
102*a* Rack
  102*b* Pinion
103 Rack-pinion mechanism
  103*a* Rack
  103*b* Pinion
201 Cap member
202 Cap holder
203 First rack
204 Moving body
205 Slider
206 Main body part of moving body
207 Spring
208 Gear
208 Support
210 Spring
211 Second rack
212 Record head
213 Carriage

What is claimed is:

1. A liquid ejecting apparatus comprising:

a liquid ejecting head, provided movably between an ejection area in which ejection control of droplets is possible based on ejection date and a non ejection area in which ejection control of droplets based on ejection data is not performed, and being capable of ejecting droplets from nozzle openings formed in a nozzle formation face;

capping means, disposed in the non-ejection area and including a cap member being capable of sealing the nozzle formation face;

drive means, which moves the cap member in an up and down direction between a nozzle formation face seal position of the liquid ejecting head and a retreat position set below the nozzle formation face seal position, a fixed frame, disposed below a move path of the liquid ejecting head in the non-ejection area, and having a guide long hole extending in the up and down direction; and a support shaft, which supports the cap member and inserted into the guide long hole, wherein the drive means has a rack-pinion mechanism including a rack disposed on both side parts of the fixed frame and a pinion fixedly secured to both end parts of the support shaft for guiding the support shaft in the up and down direction; and wherein the support shaft is moved in the up and down direction along the guide long hole so that the nozzle formation face is capped by the capping member.

2. The liquid ejecting apparatus as set forth in claim 1, wherein the capping means includes a cap holder for holding the cap member and a hold frame for holding the cap holder.

3. The liquid ejecting apparatus as set forth in claim 2, wherein the cap member and the cap holder are formed in one piece.

4. The liquid ejecting apparatus as set forth in claim 2 wherein the cap holder is formed with a wiping member for wiping the nozzle formation face.

5. The liquid ejecting apparatus as set forth in claim 1, wherein the drive means includes a cam member for sliding the support shaft.

6. The liquid ejecting apparatus as set forth in claim 5, comprising a suction pump which includes a drive source and a pump unit for applying a negative pressure in the cap member.

wherein the cam member is moved in a direction orthogonal to the move path of the liquid ejecting head by an operation of the suction pump.

7. The liquid ejecting apparatus as set forth in claim 6, wherein a driving force transmit unit is disposed between the cam member and the drive source; and wherein a driving force from the drive source is transmitted through the driving force transmit unit to the cam member.

* * * * *